US009701001B2

(12) United States Patent
Fleischer et al.

(10) Patent No.: US 9,701,001 B2
(45) Date of Patent: Jul. 11, 2017

(54) MOTOR-DRIVEN FASTENING TOOL

(71) Applicant: Arrow Fastener Co., LLC, Saddle Brook, NJ (US)

(72) Inventors: Eric Charles Fleischer, New York, NY (US); Eric Gimson Harper, Flemington, NJ (US)

(73) Assignee: Arrow Fastener Co., LLC, Saddle Brook, NJ (US)

( * ) Notice: Subject to any disclaimer, the term of this patent is extended or adjusted under 35 U.S.C. 154(b) by 480 days.

(21) Appl. No.: 14/266,050

(22) Filed: Apr. 30, 2014

(65) Prior Publication Data

US 2015/0314433 A1 Nov. 5, 2015

(51) Int. Cl.

| | |
|---|---|
| ***B25C 1/06*** | (2006.01) |
| ***B25C 5/15*** | (2006.01) |
| *B25D 11/10* | (2006.01) |

(52) U.S. Cl.

CPC ..... *B25C 5/15* (2013.01); *B25C 1/06* (2013.01); *B25D 11/102* (2013.01)

(58) Field of Classification Search

CPC .... B25C 7/00; B25C 1/04; B25C 1/06; B25C 1/008; B25C 5/15; B25C 5/10; B25C 5/0228; B25D 11/102

USPC ..... 227/8, 120, 131, 132, 2; 267/148, 162, 267/166; 173/202, 203, 205, 120, 122, 173/114, 124

See application file for complete search history.

(56) References Cited

U.S. PATENT DOCUMENTS 3,042,924 A 7/1962 Frostad
3,305,156 A 2/1967 Khan
3,513,918 A * 5/1970 Coffman ..... B25D 11/102 173/203
3,924,692 A 12/1975 Saari
4,082,152 A * 4/1978 Whitworth ..... B25D 11/102 172/123
4,380,312 A 4/1983 Landrus
4,572,419 A 2/1986 Klaus et al.
(Continued)

FOREIGN PATENT DOCUMENTS

CN 204505179 U 7/2015
DE 8907788 U1 10/1989
(Continued)

OTHER PUBLICATIONS

Extended European Search Report for corresponding Application No. 15165775.6, mailed Jan. 22, 2016, 7 pages.

*Primary Examiner* — Scott A. Smith

(74) *Attorney, Agent, or Firm* — Brooks Kushman P.C.; Lora Graentzdoerffer

(57) ABSTRACT

A fastening tool is provided with a housing having a fastener outlet. A striker is mounted for translation in the housing to drive a fastener from the fastener outlet in an unloaded position. A biasing member cooperates with the striker to urge the striker towards the unloaded position. A motor is oriented in the housing. A cam is driven by the motor, and has a cam surface in cooperation with the striker such that rotation of the cam translates the striker to a loaded position and to a release position whereby the biasing member drives the striker to the unloaded position. The cam surface is profiled to require a constant torque from the rotary input during translation of the striker to the loaded position while loading the biasing member.

17 Claims, 4 Drawing Sheets

(56) References Cited

U.S. PATENT DOCUMENTS 4,592,502 A 6/1986 Judge
4,640,452 A * 2/1987 Matt ..... B25C 1/06 173/53
4,726,505 A * 2/1988 Okazaki ..... B25C 5/15 227/120
4,807,793 A * 2/1989 Ghibely ..... B25C 5/15 227/131
4,811,885 A 3/1989 Lai
4,953,774 A * 9/1990 Lai ..... B25C 5/15 227/131
4,984,640 A * 1/1991 Gillan ..... B21J 7/42 173/114
5,503,319 A * 4/1996 Lai ..... B25C 5/15 173/203
5,605,268 A 2/1997 Hayashi et al.
5,836,403 A * 11/1998 Putney ..... B25B 21/02 173/109
5,927,585 A * 7/1999 Moorman ..... B25C 1/06 173/203
5,941,441 A * 8/1999 Ilagan ..... B25C 1/00 227/131
6,785,950 B1 * 9/2004 Scirbona ..... B25D 11/102 173/203
7,152,774 B2 * 12/2006 Chen ..... B25C 1/06 227/129
7,494,037 B2 2/2009 Simonelli et al.
7,506,693 B2 * 3/2009 Stirm ..... B25D 11/005 173/104
7,743,847 B2 * 6/2010 Fisher ..... B25D 11/102 173/109
7,832,610 B2 * 11/2010 Tanimoto ..... B25C 1/06 227/131
7,992,756 B2 * 8/2011 Franz ..... B25C 1/06 227/131
8,505,798 B2 8/2013 Simonelli et al.
2007/0045378 A1 3/2007 Liu
2007/0221698 A1 9/2007 St. John et al.
2008/0142564 A1 6/2008 Co
2009/0194576 A1 8/2009 Wang
2009/0236387 A1 * 9/2009 Simonelli ..... B25C 1/008 227/8
2010/0116864 A1 5/2010 Lamb
2013/0112448 A1 * 5/2013 Profunser ..... B25B 21/02 173/93.5
2014/0001227 A1 1/2014 McNeill et al.
2015/0352702 A1 12/2015 Chien

FOREIGN PATENT DOCUMENTS

EP 0231945 A1 8/1987
GB 2260289 A 4/1993

* cited by examiner

MOTOR-DRIVEN FASTENING TOOL

TECHNICAL FIELD

Various embodiments relate to motor-driven fastening tools.

BACKGROUND

Power fastening tools include various driving mechanisms. One fastening tool includes a solenoid actuator that drives a blade which drives a fastener. Another fastening tool includes a motor-driven gearbox with an eccentric drive which lifts a plunger against a spring, then releases the plunger, with the spring driving the plunger and attached blade which drives the fastener. Another fastening tool includes a motor-driven gearbox that drives a linkage to compress air in a cylinder. The compressed air is then released into a smaller cylinder, driving a blade which drives a fastener. Another fastening tool includes a battery to power a device which ignites an air-fuel mixture, from which a rapid expansion within a cylinder drives a plunger and attached blade which drives the fastener.

SUMMARY

According to at least one embodiment, a fastening tool is provided with a housing having a fastener outlet. A striker is mounted for translation in the housing to drive a fastener from the fastener outlet in an unloaded position. A biasing member cooperates with the striker to urge the striker towards the unloaded position. A motor is oriented in the housing. A transmission is coupled to the motor to receive a rotary input from the motor and to provide a rotary output. A cam is coupled to the transmission to receive the rotary output. The cam has a cam surface in cooperation with the striker such that rotation of the cam translates the striker to a loaded position and to a release position whereby the biasing member drives the striker to the unloaded position. The cam surface is profiled to require a constant torque from the rotary input during translation of the striker to the loaded position while loading the biasing member.

According to at least another embodiment, a fastening tool is provided with a housing having a fastener outlet. A striker is mounted for translation in the housing to drive a fastener from the fastener outlet in an unloaded position. A biasing member cooperates with the striker to urge the striker towards the unloaded position. A motor is oriented in the housing. A transmission is coupled to the motor to receive a rotary input from the motor and to provide a rotary output. A cam is coupled to the transmission to receive the rotary output. The cam has a cam surface in cooperation with the striker such that rotation of the cam translates the striker to a loaded position and to a release position whereby the biasing member drives the striker to the unloaded position. The cam surface is profiled to reduce an input torque from the rotary input at an intermediate position between the loaded position and the unloaded position.

According to at least another embodiment, a fastening tool is provided with a housing having a fastener outlet. A striker is mounted for translation along an axis in the housing to drive a fastener from the fastener outlet in an unloaded position. A biasing member cooperates with the striker to urge the striker towards the unloaded position. A motor is oriented in the housing parallel to the striker axis. A transmission is coupled to the motor in alignment with the motor, to receive a rotary input from the motor and to provide a rotary output. A cam is coupled to the transmission in alignment with the transmission to receive the rotary output. The cam has a cam surface in cooperation with the striker such that rotation of the cam translates the striker to a loaded position and to a release position whereby the biasing member drives the striker to the unloaded position.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
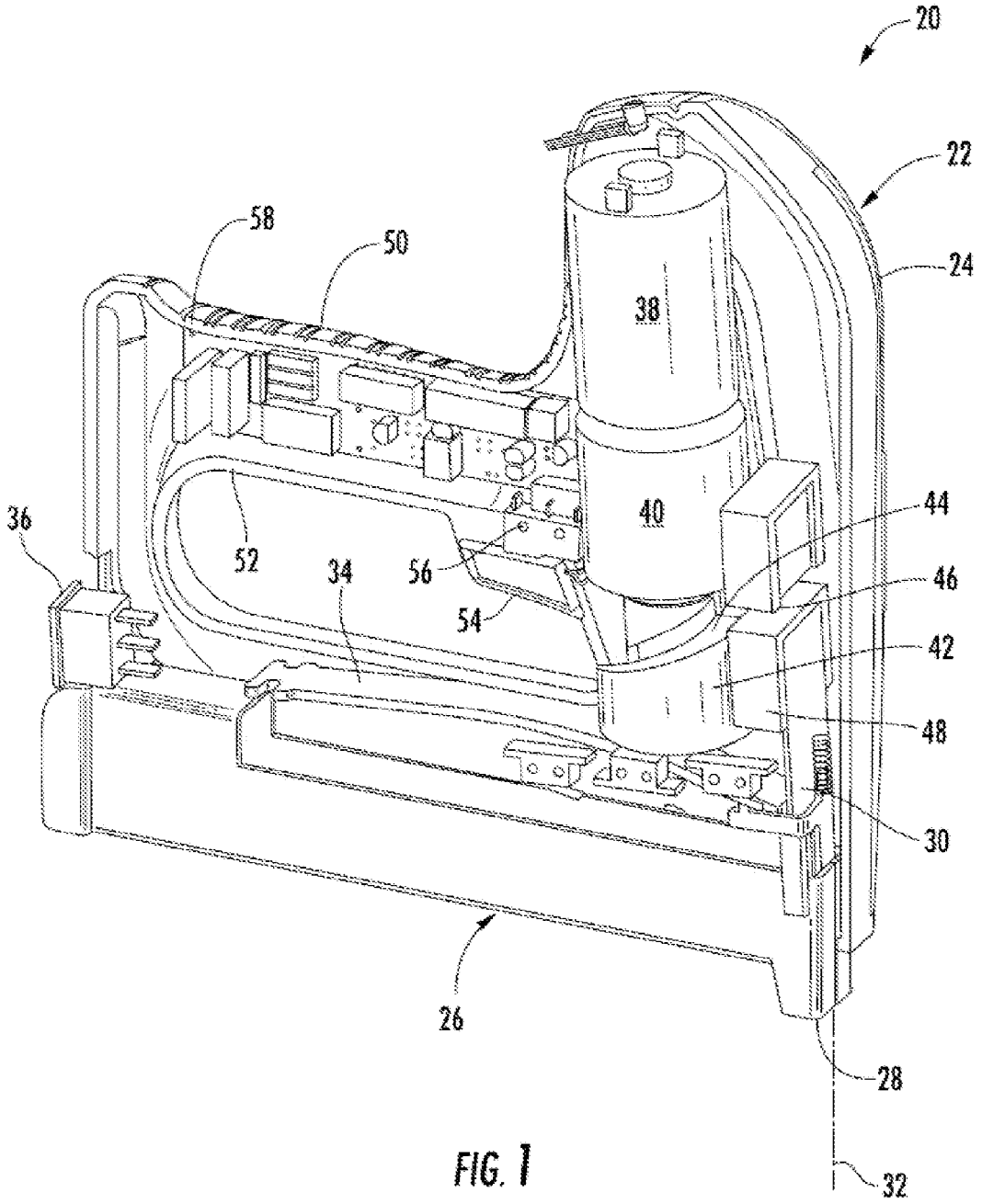
FIG. 1 is a fragmentary perspective view of a fastening tool according to an embodiment.

With reference now to FIG. 1, a fastening tool 20 is illustrated according to an embodiment. The fastening tool 20 is depicted as a fastening tool for dispensing staples and brad nails, also known as a tacker. Of course various power fastening tools are contemplated.

The fastening tool 20 is depicted as a handheld power tool. The fastening tool 20 has a housing 22 that is formed from a pair of housing portions, of which housing portion 24 is depicted in FIG. 1. The housing 22 includes a mating housing portion (not shown) to the housing portion 24 which collectively retain and enclose functional components therein. The fastening tool 20 includes a magazine 26, as known in the art, which retains a series or strip of fasteners therein. The fasteners may be adhered together, as is known in the art. A fastener outlet 28 is provided in the housing 22 for egress of a fastener from the magazine 26. The magazine 26 is spring-loaded to move the fasteners forward after each fastener is driven from the magazine 26.

A striker 30 is mounted in the housing 22 for linear translation in the housing 22 along an axis 32 through the fastener outlet 28. The striker 30 is referred to as a blade due to its shape and, in some embodiments, the blade 30 shears one fastener from the strip of fasteners. The blade 30 is connected to a biasing member or power spring 34 provided by a plurality of stacked leaf springs as shown, or as a singular leaf spring that is thicker that the individual springs shown. Translation of the blade 30 to a loaded position deforms the power spring 34 thereby loading the power spring 34, such as that depicted in FIG. 1. At the loaded position, the blade 30 provides clearance in the magazine 26 to translate the strip to present the next sequential fastener in alignment with the fastener outlet 28. Release of the blade 30 causes the power spring 34 to drive the blade 30 to an unloaded position thereby impacting the fastener, and driving the fastener from the fastener outlet 28 and into a workpiece.

A power source is provided to the fastening tool 20, by an electrical input, which is regulated by a power switch 36. The power source may be supplied by a cord that is plugged into an external power supply. Alternatively, the power source may be connected to a battery for a cordless power tool. The power source is connected to an electrical motor 38. The electrical motor 38 is depicted aligned parallel to, and offset from the striker axis 32. The motor 38 provides a rotary input to a transmission or gearbox 40 which reduces an input rotational speed from the motor 38 while increasing an output torque, which is depicted in coaxial alignment. A cylindrical cam 42 is coupled to the gearbox 40 and driven by a rotary output of the gearbox 40, which is also depicted in coaxial alignment to the gearbox 40 and the motor 38. The cam 42 has a cam surface 44 that is in engagement with a follower 46 on a plunger or carriage 48. The carriage 48 is mounted for translation in the housing 22 and supports the blade 30. Rotation of the cam 42 raises the carriage 48, and consequently the blade 30 to the loaded position, and subsequently releases the blade 30. Further rotation of the cam 42 reengages the follower 46 of the carriage 48 and repeats this operation.

The housing 22 is formed with a handle grip portion 50 for manual gripping of the fastening tool 20. An aperture 52 is formed in the housing 22 between the handle grip portion 50 and the magazine 26 for receipt of fingers of a user. A manual actuator, such as a trigger 54 extends from the housing 22 into the aperture 52 for manual control. The trigger 54 actuates a manual switch 56 that is in electrical communication with a controller or printed circuit board 58 that may be oriented within the handle grip portion 50 for controlling power to the motor 38.

Figure 2:
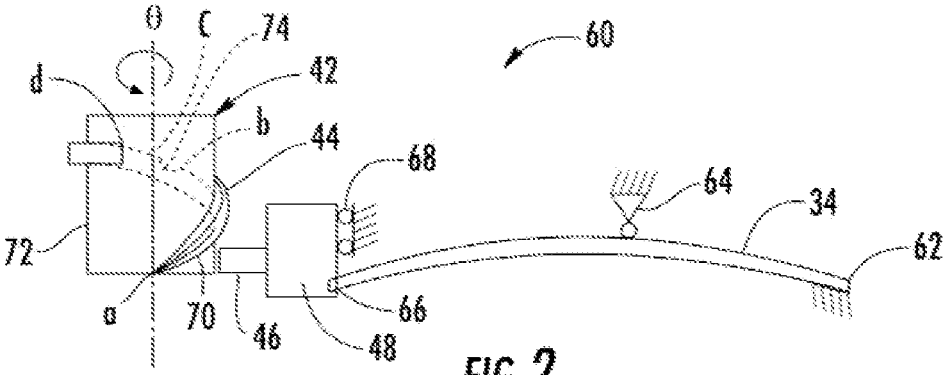
FIG. 2 is a schematic view of a drive mechanism of the fastening tool of FIG. 1.

Referring now to FIG. 2, a drive mechanism 60 of the fastening tool 20 is illustrated schematically. The drive mechanism 60 includes the power spring 34, which is retained in the housing 22 at a proximal end 62. The housing 22 also provides a fulcrum 64 for engaging the power spring 34 during deformation of the power spring 34. A distal end 66 of the power spring 34 is engaged with the carriage 48, which is supported for translation in the housing 22 by bearings 68. The cam 42 rotates in a direction that is clockwise when viewed in a downward direction in FIG. 2. The cam 42 includes a helical rib 70 extending from a cylindrical body 72 of the cam 42 to provide the cam surface 44 to engage the follower 46, which may include a roller bearing or bushing for reducing friction.

Prior art eccentric drives provide a sinusoidal translation of the plunger. Due to increasing force caused by deformation of a power spring, an output torque required of a motor of a prior art eccentric drive is not linear with a peak torque midway through the cycle. The prior art motor is sized based on the peak torque. Conversely, very little torque is required at the beginning of the cycle. Eccentric drives often release the blade at the loaded position and reengage almost half a rotation from release, resulting in very little work for half the cycle.

Figure 3:
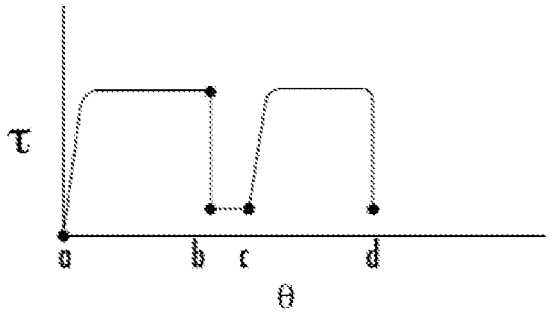
FIG. 3 is a graph of torque over rotation of the drive mechanism of FIG. 2.

The inefficiencies of the prior art are minimized by the cam surface 44. The cam surface 44 includes a slope that decreases as the carriage 48 is raised against the power spring 34. Therefore, as the force required to deform the power spring 34 increases, the slope decreases. The slope of the cam surface 44 is greatest after engagement with the follower 46 at 'a' and steadily decreases until release at position 'd'. FIG. 3 illustrates a graph of torque $\tau$ required by the cam 42 over rotary displacement indicated by $\theta$. After engagement of the follower 46 to the cam surface 44 at point 'a', the torque increases, then remains generally constant due to the decreasing slope of the cam surface 44.

By levelling off the torque, the work is distributed through the cycle, thereby lowering a peak torque in comparison to prior art eccentric drives. Additionally, by offsetting the release position 'd' and the reengagement position 'a' by less than a half rotation, the work is distributed across an almost full cycle, instead of a half cycle. By lowering the peak torque, a smaller motor 38 is employed in comparison to prior art tools. The smaller motor 38 results in a smaller, more compact tool 20, thereby improving functionality and reducing weight. The smaller motor 38 consequently uses less energy. For battery-operated tools, a larger quantity of cycles may be performed before requiring recharging or replacement of the battery. Large fluctuations of motor load generally shorten motor life; and therefore, motor life may be lengthened with a more consistent torque load.

Figure 4:
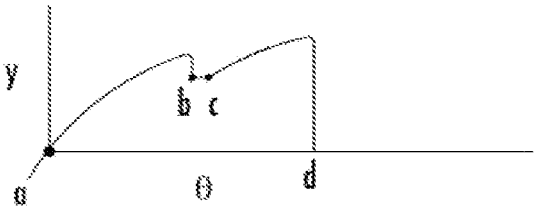
FIG. 4 is a graph of displacement over rotation of the drive mechanism of FIG. 2.

FIG. 4 illustrates the slope of the cam surface 44 depicted in a Cartesian graph of displacement y, or deflection of the power spring 34, over rotary displacement $\theta$. The slope can be mathematically derived to allow nearly constant motor torque during lifting operations.

Referring again to FIG. 2, the cam surface includes a detent 74 to allow the spring 34 to be held partially loaded. The detent 74 is illustrated at rotational locations 'b' and 'c' in the graphs of FIGS. 3 and 4. After a fastener is driven from the outlet 28, the controller 58 may begin a subsequent cycle, and stop at the detent 74 until a subsequent manual trigger pull. By holding the spring 34 partially loaded, near the release point 'd', a faster response to user input is provided as compared to awaiting a full cycle. The detent 74 permits the follower 46 to rest thereby avoiding back-driving a resultant torque to the transmission 40 and motor 38. The detent 74 may be oriented at an intermediate position wherein the blade 30 is not fully raised, thereby preventing advancement of the sequential fastener. In a failure condition of the fastening tool 20, such as an impact, a fastener is not aligned with the blade 30 to prevent an inadvertent fastener discharge.

Figure 5:
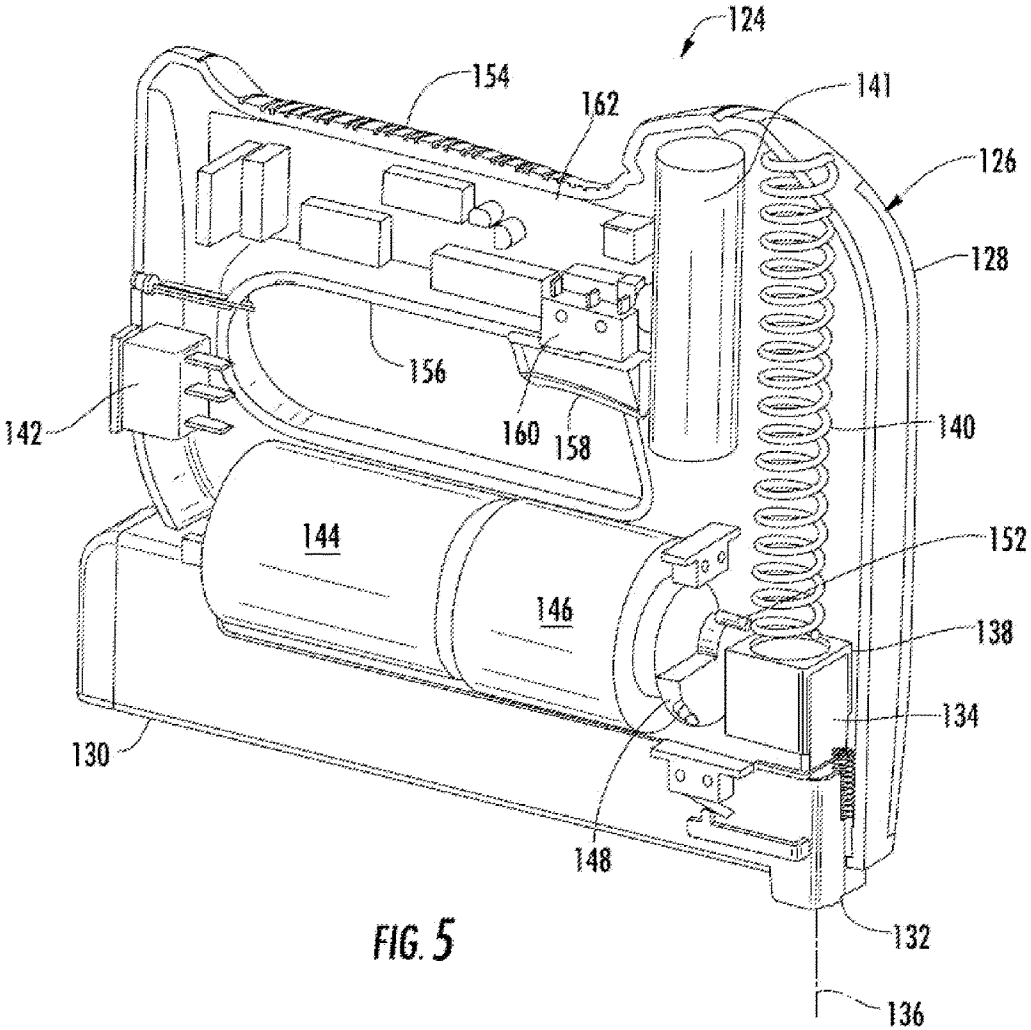
FIG. 5 is a fragmentary perspective view of a fastening tool according to another embodiment.

FIG. 5 depicts a fastening tool 124 according to another embodiment. The fastening tool has a housing 126 that is formed from a pair of housing portions, of which housing portion 128 is depicted. The fastening tool 124 includes a fastener magazine 130. A fastener outlet 132 is provided in the housing 126. A blade 134 is mounted in the housing 126 for linear translation along an axis 136. The blade 134 is connected to a carriage 138, which is also mounted to the housing 126 for translation. A power spring 140 is provided by a compression spring. Translation of the carriage 138 to a loaded position deforms the power spring 140 thereby loading the power spring 140.

A power source, such as a battery 141 is provided in the housing. A power switch 142 controls a functional condition of the tool 124. The battery 141 provides an electrical input that is connected to an electrical motor 144. The electrical motor 144 is depicted aligned perpendicular to the blade axis 136. The motor 144 provides a rotary input to a gearbox 146 which reduces an input rotation from the motor 144 while increasing an output torque, which is depicted in coaxial alignment. A spiral cam 148 is coupled to the gearbox 146 and driven by a rotary output of the gearbox 146, which is also depicted in coaxial alignment to the gearbox 146 and the motor 144. The cam 148 has a cam surface 150 that is in engagement with a follower 152 on the carriage 138. Rotation of the cam 148 raises the carriage 138, and consequently the blade 134 to the loaded position, and subsequently releases the blade 134. Further rotation of the cam 148 repeats this operation.

The housing 126 is formed with a handle grip portion 154 for manual gripping of the fastening tool 124. An aperture 156 is formed in the housing 126 between the handle grip portion 154 and the magazine 130 for receipt of fingers of a user. A trigger 158 extends from the housing 126 into the aperture 156 for manual control. The trigger 158 actuates a manual switch 160 that is in electrical communication with a controller or printed circuit board 162 that may be oriented within the handle grip portion 154 for controlling power to the motor 144.

Figure 6:
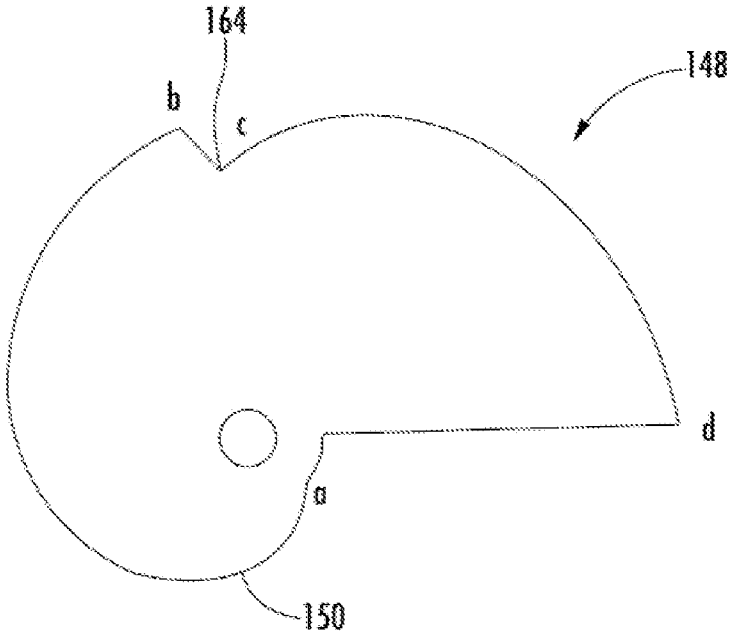
FIG. 6 is an axial end view of a drive mechanism of the fastening tool of FIG. 9.
Figure 7:
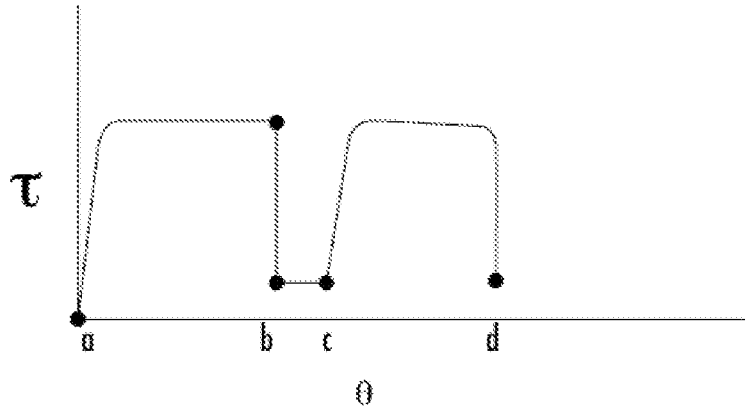
FIG. 7 is a graph of torque over rotation of the drive mechanism of FIG. 10.
Figure 8:
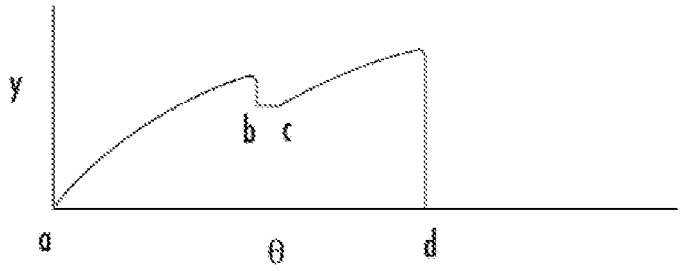
FIG. 8 is a graph of displacement over rotation of the drive mechanism of FIG. 10.

FIG. 6 illustrates the cam 148, which is configured for torque and displacement similar to the first embodiment. Translation of the blade 134, and loading of the spring 140 occurs between points 'a' and 'd.'. The cam 148 includes a detent 164 at points 'b' and 'c' for a temporary reduction of torque. FIGS. 7 and 8 illustrate similar torque C versus displacement D and deflection y versus displacement D characteristics to the first embodiment. Orientation of the motor 144 and gearbox 146 horizontally permits different packaging of the fastening tool 124.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A fastening tool comprising:

a housing having a fastener outlet;

a striker mounted for translation in the housing to drive a fastener from the fastener outlet in an unloaded position;

a biasing member cooperating with the striker to urge the striker towards the unloaded position;

a motor oriented in the housing;

a transmission coupled to the motor to receive a rotary input from the motor and to provide a rotary output; and a cam coupled to the transmission to receive the rotary output, the cam having a cam surface in cooperation with the striker such that rotation of the cam translates the striker to a loaded position and to a release position whereby the biasing member drives the striker to the unloaded position, wherein the cam surface is profiled to require an input torque while loading the biasing member and to require a subsequent input torque at an intermediate position that is less than the prior input torque.

2. The fastening tool of claim 1 wherein a detent is formed in the cam at the intermediate position.

3. The fastening tool of claim 2 wherein the detent in the cam is shaped to permit the biasing member to be held in a partially loaded position in a rest condition of the fastening tool.

4. The fastening tool of claim 3 further comprising a controller in electrical communication with the motor and programmed to:

receive input indicative of a trigger pull;

drive the motor until a fastener is driven from the fastener outlet by unloading the biasing member;

continue to drive the motor thereby reloading the biasing member until the striker reaches the detent in the cam; and discontinue to drive the motor so that the striker rests at the detent in the cam with the biasing member partially loaded before receiving an input indicative of a subsequent trigger pull.

5. The fastening tool of claim 3 wherein the detent is formed in the cam at an orientation wherein the striker is not fully raised to prevent inadvertent advancement of a sequential fastener.

6. The fastening tool of claim 1 wherein the cam has a cylindrical body with the cam surface formed thereabout.

7. The fastening tool of claim 6 wherein a slope of the cam surface generally decreases from the unloaded position to the loaded position.

8. The fastening tool of claim 6 wherein the cam comprises a helical rib projecting from the cylindrical body to form the cam surface.

9. The fastening tool of claim 8 further comprising a cam follower mounted to the striker for engagement with the helical rib.

10. The fastening tool of claim 1 wherein the striker is mounted for translation along an axis in the housing; and wherein the motor is oriented in the housing parallel to the striker axis.

11. The fastening tool of claim 10 wherein the transmission is oriented in alignment with the motor.

12. The fastening tool of claim 11 wherein the cam is oriented in alignment with the transmission.

13. The fastening tool of claim 1 wherein the striker is mounted for translation along an axis in the housing; and wherein the motor is oriented in the housing perpendicular to the striker axis.

14. The fastening tool of claim 13 wherein the transmission is oriented in alignment with the motor.

15. The fastening tool of claim 14 wherein the cam is oriented in alignment with the transmission.

16. A fastening tool comprising:

a housing having a fastener outlet;

a striker mounted for translation in the housing to drive a fastener from the fastener outlet in an unloaded position;

a biasing member cooperating with the striker to urge the striker towards the unloaded position;

a motor oriented in the housing;

a transmission coupled to the motor to receive a rotary input from the motor and to provide a rotary output; and a cam coupled to the transmission to receive the rotary output, the cam having a cam surface in cooperation with the striker such that rotation of the cam translates the striker to a loaded position and to a release position whereby the biasing member drives the striker to the unloaded position, wherein a detent is formed in the cam at an intermediate position, and the detent in the cam is shaped to permit the biasing member to be held in a partially loaded position in a rest condition of the fastening tool.

17. A fastening tool comprising:

a housing having a fastener outlet;

a striker mounted for translation in the housing to drive a fastener from the fastener outlet in an unloaded position;

a biasing member cooperating with the striker to urge the striker towards the unloaded position;

a motor oriented in the housing;

a transmission coupled to the motor to receive a rotary input from the motor and to provide a rotary output;

a cam coupled to the transmission to receive the rotary output, the cam having a cam surface in cooperation with the striker such that rotation of the cam translates the striker to a loaded position and to a release position whereby the biasing member drives the striker to the unloaded position, wherein a detent is formed in the cam at an intermediate position; and a controller in electrical communication with the motor and programmed to:

receive input indicative of a trigger pull, drive the motor until a fastener is driven from the fastener outlet by unloading the biasing member, continue to drive the motor thereby reloading the biasing member until the striker reaches the detent in the cam, and discontinue to drive the motor so that the striker rests at the detent in the cam with the biasing member partially loaded before receiving an input indicative of a subsequent trigger pull.

* * * * *